United States Patent [19]

Anderson

[11] Patent Number: 4,684,163

[45] Date of Patent: Aug. 4, 1987

[54] STRAP ASSEMBLY FOR SECURING AND TRANSPORTING MAIL

[76] Inventor: Richard T. Anderson, 1614 Morris Ct., North Wales, Pa. 19454

[21] Appl. No.: 867,210

[22] Filed: May 27, 1986

[51] Int. Cl.[4] ..... B65D 63/16

[52] U.S. Cl. ..... 294/149; 294/150; 294/155

[58] Field of Search ..... 294/149, 138, 150, 155, 294/154, 157, 165, 74, 152, 137; 5/89; 206/278

[56] References Cited

U.S. PATENT DOCUMENTS 2,532,306 12/1950 Herbert ..... 294/150

3,865,292 2/1975 Foley ..... 294/149

4,114,838 9/1978 Knauf ..... 294/157

*Primary Examiner*—James B. Marbert

*Attorney, Agent, or Firm*—Joseph W. Molasky & Assocs.

[57] ABSTRACT

A resilient strap assembly for securing and carrying mail or similar articles in a stacked arrangement. The straps are in a cross-like configuration and their outermost ends are equipped with fasteners which can be secured to one another to ensure that the stacked material will be securely retained and can be transported without inadvertent disassembly.

9 Claims, 4 Drawing Figures

FIG. 2
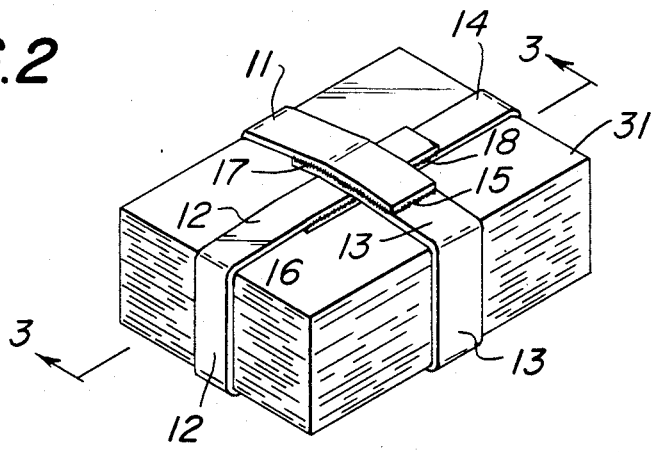
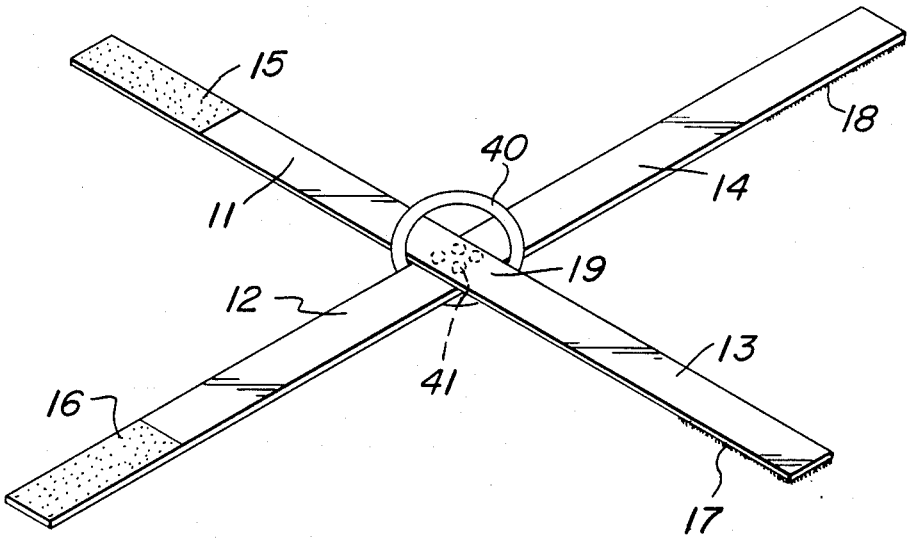
FIG. 4

STRAP ASSEMBLY FOR SECURING AND TRANSPORTING MAIL

This invention relates to a strap assembly for securing and carrying mail in a stacked arrangement.

This invention may also be used to secure and carry books, newspapers or similar material but the primary object is to provide an improved means for assembling mail in stack form as a discrete package.

The assembly of this invention consists essentially of intersecting straps which encircle the bundle and cross at their midpoint. Fasteners are attached to the outermost ends of the straps and these overlap and connect with one another to provide a securing means.

A discrete or integrally formed handle is also provided for manual handling.

BACKGROUND OF THE INVENTION

The stacking of mail is a tedious operation because irregularly shaped articles such as magazines, pamphlets, postcards, brochures, envelopes or product samples are superimposed one on top of the other in a vertical alignment and some restraint is needed to retain the bundle in stack form.

Presently, the U.S. Postal Service provides employees with narrow flaccid straps which encircle the bundle to prevent article displacement. These straps are comprised of canvas or similar non-resilient material and they measure about 1 inch in width. The ends of these straps may include a buckle-type fastener and an encircled portion thereof is usually used as a handle means. Unfortunately, the bundles assembled in this manner are not secure because the narrow straps leave large portions of the mail exposed and individual pieces are easily dislodged and can become separated. This difficulty is exacerbated by the fact that the straps have no resilience and, as a result, they exert little or no holding effect on the mail pieces with which they are in contact.

Also, the buckle-type fasteners which are used to secure the presently available straps create an unstable package because the buckle is cumbersome and its size makes it difficult to position the bundle on a flat surface. Moreover, such bundles cannot be stacked on top of one another with any assurance and, therefore, they do not contribute to an efficient utilization of space.

As a result, postal service employees usually assemble small bundles of an easily manageable size but this too is improvident because smaller bundles require a larger expenditure of time and materiel to assemble and additional time is needed to convey these multiple stacks to their destination.

Accordingly, there is a need for a strap assembly which can be used to secure and carry an essentially large volume of mail in a safe, convenient, reliable and economical manner with no diminuition of employee efficiency.

THE INVENTION

It is an object of this invention to provide means for receiving, securing and carrying a stack of mail by the use of encircling straps which intersect one another at their midpoint.

A further object provides means for securing the outermost ends of said straps to one another so as to provide a coherent package which cannot be accidentally disassembled.

Still another object consists of utilizing the midpoint of the strap assembly to provide an ovular-type hand grip which can be used to transport a stack of mail in an assembled and secure mode.

The present invention may be used per se as a device for securing and carrying mail in a stack form but a preferred embodiment provides for utilizing same in combination with a bundling container which facilitates the stacking process.

The assembly consists essentially of two flat elongated straps which are disposed at right angles to one another and which are joined at their midpoint so that they define a cross-like configuration.

The outermost ends of said straps are equipped with a fastening means so that in its assembled mode the strap ends can be joined to one another. The fastening means may be a hook and eyelet combination or snaps or, preferably, a coupling device of the hook and loop variety commonly known as a Velcro® fastener.

The strap assembly may be discretely formed as a unitary device from a single sheet of flexible and resilient material such as neoprene or latex rubber or, alternatively, the straps may be formed individually as discrete segments and joined at their midpoint by adhesive or stitching means.

According to the preferred embodiment of this invention the strap assembly thus constructed is placed into a container having rigid and vertically disposed endwalls and sidewalls. The bottom segment of this container is also rigid and it includes a recess portion of cross-like configuration which is adapted to receive the like-configured strap. The endwalls and sidewalls of said container also possess cutout segments which correspond to the cross-like configuration so that the strap ends can move downwardly within the sidewalls for alignment with the recess portion.

Once the strap assembly has been positioned within said recess the stacking operation is commenced and the articles which are to be baled are placed within the container on top of the intersecting straps in a vertical alignment. Thereafter, the straps are drawn up to encircle the stack and their outermost ends are folded over and secured to one another to form a discrete package. The package thus assembled and its bundling container are then transported by hand to a desired location for shipment according to means which are described hereinafter in greater detail.

THE DRAWINGS

FIG. 2 is a perspective view of a mail stack secured by the present device.

FIG. 4 is a perspective view of an embodiment in which the present device is equipped with an ovular handle.

This invention will now be described by making reference to precise embodiments but it is to be understood that these are for illustration only and that the invention is not to be construed as being limited thereto.

DESCRIPTION OF THE PREFERRED EMBODIMENTS

Figure 1:
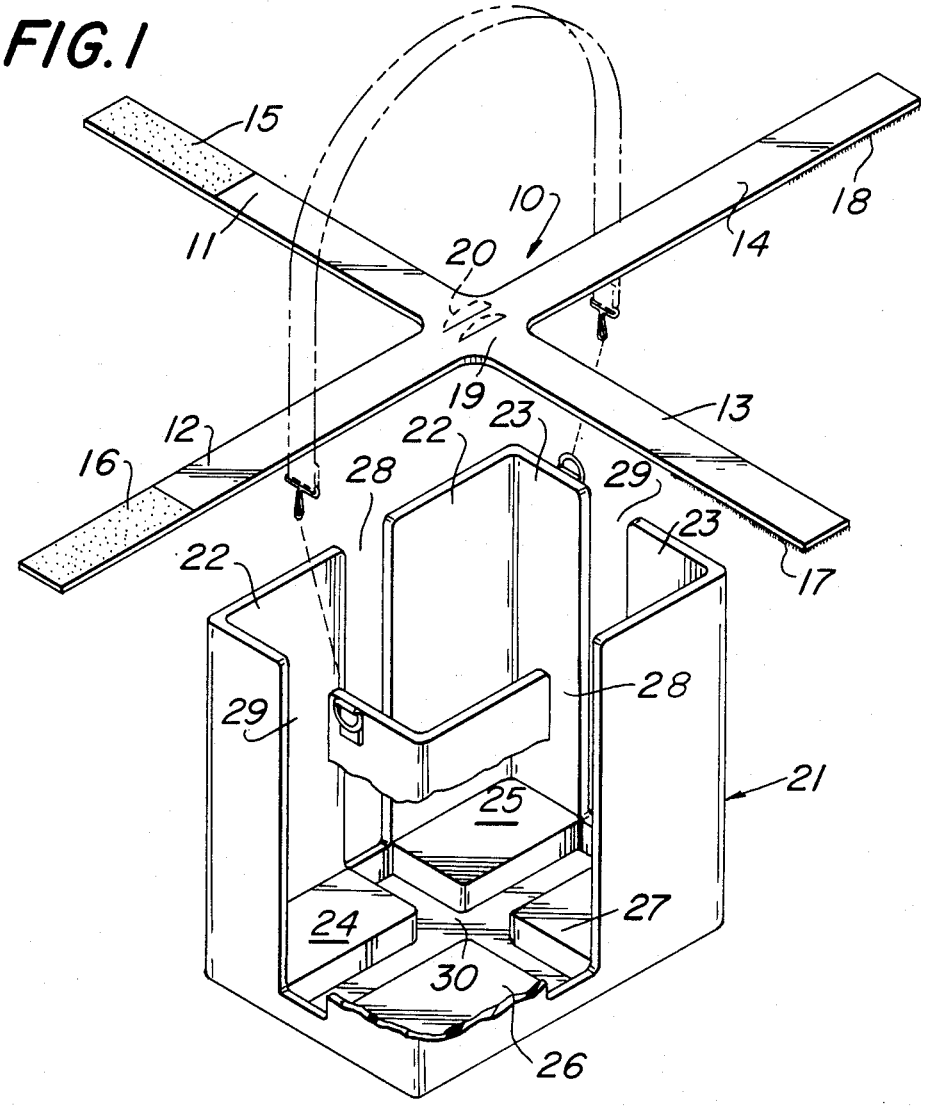
FIG. 1 is a perspective view of the device of this invention and a baling container.

FIG. 1 illustrates the strap assembly 10 in a flat configuration positioned above the container with which it is employed. This assembly consists essentially of elongated straps 11–14 which radiate outwardly from midpoint 19 in such manner that each strap is transverse to one another and perpendicular to an adjacent pair.

Each strap includes an outermost segment 15–18 equipped with a fastening means as, for example, a fastener of the hook and loop type which is secured to one surface only of said segment by an adhesive bonding means, however, it is to be understood that other functionally equivalent fasteners may also be employed with good results. In practice, the fastening means is employed by drawing straps 11–14 up and around the mail stack so that the outermost segments 15–18 can be made to overlap one another and bring into engagement their respective fasteners. The result of this engagement is a bale or secured stack of mail of the type shown as 31 in FIGS. 2 and 3.

The straps of the present invention may be fabricated from any elastic material which will exert a gripping effect. Rubber of the latex variety is particularly suitable because its flexibility and frictional characteristics are such that the straps conform to the configuration of the mail which is to be baled and prevent lateral movement.

If desired, the straps of this invention may also be color-coded to provide a means for identifying mail of particular content or mail which has been baled on a certain day or during a given period.

The strap assembly may be unitary as shown in FIG. 1 or the assembly may be formed from two individual pieces which are joined together at the point of intersection by an adhesive 41 as shown in FIG. 4.

The present device also includes a handle means. This handle may be integrally formed by impressing into the strap assembly at its midpoint 16, that is, the point of intersection for straps 11–14, a pair of parallel incisions so as to provide a manipulable strip 20 which can be drawn upwards by finger means. When this strip is raised sufficiently from the strap surface it forms an ovular handle through which the hand can be inserted for carrying purposes.

Alternatively, the handle means may be added to the strap assembly as a discrete element as shown by ring 40 in FIG. 4. According to this embodiment a circular-type band is threaded onto adjacent straps and drawn toward the center of the assembly until it extends crosswise between opposing pairs of transversely disposed straps at the midpoint or point of intersection 19. This is a practical alternative to the handle shown in FIG. 1 because it avoids the tearing which can result from the repeated use of an integrally formed handle and it allows the user to add to the strap assembly a new handle in the event that a replacement becomes necessary or desirable.

A preferred embodiment of this invention provides for using the present device in combination with the container shown as 21 in FIG. 1. The side walls 22 and end walls 23 of this container are of such height that the user may erect therein a vertical stack of any desired dimension but, in general, stacks of from about 12–20 inches are most desirable because they can be moved manually by a single person without difficulty. Moreover, the container facilitates the stacking process because it prevents odd size mail such as booklets and the like from moving laterally within the stack and creating an unworkable bundle. The container may be constructed from any suitably rigid material as, for example, plastic, metal or wood but a plastic such as polystyrene or an acrylonitrile butadiene styrene copolymer or similar type of thermoplastic material is preferred for economy reasons and because it can be more easily fabricated in large quantities by known impression molding techniques.

The bottom of container 21 consists of four segments which are identified in FIG. 1 as 24–27 and these are separated from one another by a recess 30 for accepting strap 10. Cutout portions 28 and 29 in the opposing side walls 22 and end walls 23 guide the strap segments 11–14 into said recess.

The strap assembly 10 is used with container 21 by aligning the strap segments 11–14 above the cutout portions 28 and 29 and allowing them to move downwardly through the guide means into the accommodating recess 30 so that the outermost segments of the straps will extend outwardly from the container in an unimpeded manner.

Figure 3:
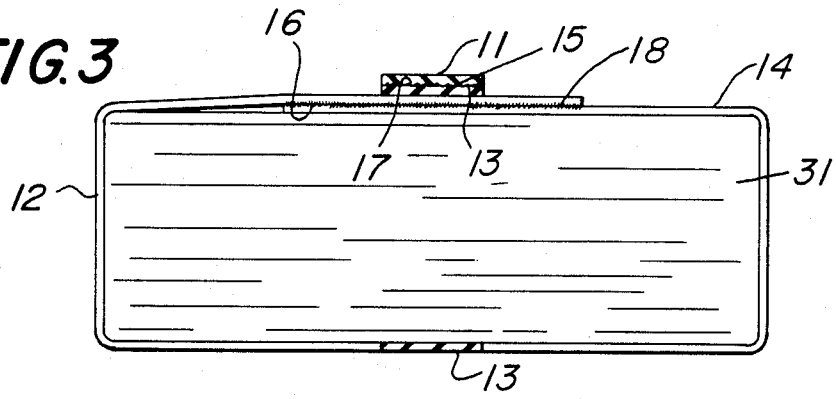
FIG. 3 is a sectional view of the mail stack shown in FIG. 2 along line 3—3.

When the straps are disposed in this manner the assembly is operable and in condition for receiving envelopes, pamphlets, bulletins and those other objects which comprise the mail, and stacking may be initiated and continue until a mail bundle of sufficient height has been erected. In practice, the stack may be equal in height to the container 21 but, as a practical matter, it is desirable to construct stacks of slightly lesser height to ensure proper containment and allow for the strap ends which must be folded over and secured to one another as shown in FIGS. 2–3.

Thereafter, the container and baled stack may be transported to a van or delivery truck by securing to said container a band equipped with securing means for manual delivery. In FIG. 1 this arrangement is illustrated by a band shown in phantom which is secured by hooks to receiving eyelets on container 21.

To remove the baled stack from the container 21 the latter is simply turned over and withdrawn to expose the handle means. FIG. 2 shows the secured stack of mail 31 as it appears when the bale is removed from the container 21. In this arrangement the outermost end segments 15–18 are joined by hook and loop fasteners which have been impressed together to provide the holding means.

This invention has been described by reference to precise embodiments but it will be appreciated by those skilled in the art that this concept is subject to variation and modification and to the extent that these are within the skill of the artisan to effect, said variations and modifications are included within the scope of the appended claims.

What is claimed is:

1. A device for receiving, securing and carrying a stack of mail or the like which comprises:

(1) two essentially flat elongated straps transversely disposed to one another in a perpendicular arrangement so that mail can be stacked thereon at the point of intersection, one strap having a length sufficient to extend around said stack in one direction and the second strap having a length sufficient to extend around said stack in a transverse direction;

(2) securing means of the hook and loop type bonded to end segments of each strap on opposing surfaces so that their respective end segments can be joined together to form a stack-securing loop; and (3) handle means for carrying the stack thus secured, said handle means being centrally disposed at the point of intersection of said straps.

2. The device according to claim 1 wherein said straps and handle means are formed from a single sheet of elastic material to provide a unitary-type apparatus.

3. The device according to claim 1 wherein said straps are discretely formed and joined at said intersection.

4. The device according to claim 3 wherein said straps are joined at said intersection by stitching means.

5. The device according to claim 3 wherein said straps are joined at said intersection by adhesive means.

6. The device of claim 1 wherein said handle means consists essentially of an elongated section which is formed from said strap at said intersection and which can be raised from the strap surface to form an ovular-type handle.

7. The device according to claim 1 wherein said handle means consists essentially of a circular band which is threadedly engaged with said straps and which extends crosswise between pairs of transversely disposed straps at their intersection.

8. The device according to claim 1 wherein said straps are formed from rubber in sheet form.

9. The device according to claim 1 wherein said straps are formed from canvas in sheet form.

* * * * *